US010538409B2

(12) United States Patent
Lohia

(10) Patent No.: US 10,538,409 B2
(45) Date of Patent: Jan. 21, 2020

(54) APPARATUS AND METHOD FOR REGULATING WINDING TENSION AS FUNCTION OF BOBBIN DIAMETER

(71) Applicant: Siddharth Lohia, Kanpur (IN)

(72) Inventor: Siddharth Lohia, Kanpur (IN)

( * ) Notice: Subject to any disclaimer, the term of this patent is extended or adjusted under 35 U.S.C. 154(b) by 89 days.

(21) Appl. No.: 15/767,351

(22) PCT Filed: Nov. 2, 2016

(86) PCT No.: PCT/IB2016/056577
§ 371 (c)(1),
(2) Date: Apr. 11, 2018

(87) PCT Pub. No.: WO2017/077453
PCT Pub. Date: May 11, 2017

(65) Prior Publication Data

US 2018/0297808 A1 Oct. 18, 2018

(30) Foreign Application Priority Data

Nov. 4, 2015 (IN) ..... 1534/DEL/2015

(51) Int. Cl.
*B65H 59/36* (2006.01)
*B65H 59/38* (2006.01)
*B65H 54/02* (2006.01)

(52) U.S. Cl.
CPC ..... *B65H 59/36* (2013.01); *B65H 54/02* (2013.01); *B65H 59/385* (2013.01); *B65H 2701/31* (2013.01)

(58) Field of Classification Search
CPC ..... B65H 59/36; B65H 59/385; B65H 54/02; B65H 2701/31
See application file for complete search history.

(56) References Cited

FOREIGN PATENT DOCUMENTS

DE 1129096 B * 5/1962 ..... B65H 59/38
DE 2100566 A1 * 7/1972 ..... B65H 59/36
(Continued)

OTHER PUBLICATIONS

Machine Translation of DE 2 100 566, Jul. 20, 1972. (Year: 1972).*

*Primary Examiner* — William E Dondero
(74) *Attorney, Agent, or Firm* — Andrus Intellectual Property Law, LLP

(57) ABSTRACT

The invention discloses an apparatus for regulating winding tension as function of bobbin (2) diameter in a slit film tape or yarn (1) winder system carrying at least one automated winder. It comprises a dancing arm (3) equipped with a tension setting means or device (3B) which regulates the yarn tension. The inventive feature of the invention is that tension setting means (3B) is capable of changing resistance 'R' of the dancing arm (3) as a function of the bobbin (2) diameter 'D' during the winding process. The invention also provides a method for regulating winding tension as function of bobbin (2) diameter. The invention helps overcome a number of problems related to uniformness and consistency of package the fabric making industry is currently facing. It solves technical problem of winding bobbin throughout using same tension adjusted for dancing arm, resulting higher tension during unwinding at low bobbin sizes. It also helps reduce the necking or shrinkage of the fabric produced due to varying resultant winding tension.

9 Claims, 5 Drawing Sheets

(56) References Cited

FOREIGN PATENT DOCUMENTS

| | | | | | |
|---|---|---|---|---|---|
| DE | 3919794 | A1 * | 12/1989 | ..... | A21C 15/02 |
| DE | 102008010365 | A1 * | 8/2009 | ..... | B65H 51/20 |
| EP | 0477491 | A2 * | 4/1992 | ..... | B65H 59/16 |

* cited by examiner

APPARATUS AND METHOD FOR REGULATING WINDING TENSION AS FUNCTION OF BOBBIN DIAMETER

FIELD OF INVENTION

The invention relates to slit film tape or yarn winding type device and a process to control yarn tension during winding such that consistent unwinding yarn tension can be achieved in relation to bobbin package diameter.

BACKGROUND OF INVENTION

A yarn winder is used for winding of continuously arriving yarn of polyolefin—flat/fibrillated or any similar type—onto a bobbin. Here, yarn defines flat tapes, multifilament and monofilament yarns or any similar type of yarns or tapes. In general, bobbin holders, also known as mandrel cores, are mounted on spindles on each winder machine frame. Each spindle needs precisely controlled rotation, so may be driven independently by an electric motor through a suitable mechanism such as a belt and pulley arrangement or with a direct driving system. Conventionally, the encoders or other similar devices for pulse generation are mounted on the motor for monitoring the motor revolutions, and the signal therefrom is communicated to the electronic controller with the help of suitable cable. The controller further sends the electrical signals to the inverter/drive of the active motor which determines the power to be given for the motor driving the spindle.

The conventional winders of the above type are disclosed in the U.S. Pat. Nos. 5,228,630, 4,765,552 and European Patent 861800A2.

In these conventional winders, yarn winding tension is controlled by regulating tightening of the oscillating arm tensioning spring (hereinafter referred to as a, dancing arm resistance for onwards references). The to and fro motion of dancing arm is monitored electronically to keep yarn delivery at nearly uniform tension with constant linear speed to spindle.

Wound bobbins produced from winders are used for further in line applications as necessary. One of the major applications of wound bobbins is in formation of tubular sacks on Circular Weaving Machines, which are also known as Circular Weaving Looms (CWM/CWL). Circular looms contain plurality of bobbins of slit film tapes used as weft and warp. Weft bobbins are arranged around a circular reed ring, such that as the main shaft drives the central part, weft bobbins start moving along the reed ring path and woven fabric produced is taken off by the fabric take off unit.

In conventional winders, winding tension of yarn is maintained by providing resistance to the motion of the dancing arm by adjusting spring attached to it. Position feedback of dancing arm is routed to the control logic of winders, which in turn rotate the bobbin mandrel such that a position of dancing arm is maintained consistently with least oscillation. To maintain the winding tension for various types of yarn of different properties like denier, width etc., the spring attached to the dancing arm is adjusted such that its variation is minimized as much possible to achieve good quality of produced bobbins. Conventionally, spring associated with dancing arm is set once at the start of the winding process, which remains constant throughout build of the bobbin as product. When the yarn from the bobbins is used as the weft yarn on a circular loom, its unwinding tension increases as the size of the bobbin decreases. This might be due to high pulling force required for rotating the bobbin at increased angular velocity, or any other unidentified reasons during winding. This increase in yarn unwinding tension results in undesirable variation in the fabric width—particularly so as weft bobbin size reduces with time. This, however, also increases necking of the fabric produced and sometimes breakage due to high weft tension.

To produce a good quality fabric of uniform width (or fabric without unacceptable variation in width), it is necessary to vary the tension in the weft bobbin tape, especially below a certain bobbin size. This variation in tension is carried out gradually or discretely from a lower to higher level as the bobbin size grows.

DE2100566A1 discloses an apparatus for regulating winding tension as a function of the bobbin diameter in a slit-film or yarn winder and discloses that the tension setting device for changing the yarn tension used therein changes the tension as a function of the bobbin diameter.

DE1129096B state that "in order to obtain a good winding structure, it has also already been proposed to vary this loading or unloading of the thread feeler as a function of the growing roll or of the emigration or position of the feeler lever so that the thread tension decreases during the winding setup." It further provides a means for doing so.

DE3913794 state that "for certain winding-up purposes, it is also advantageous to reduce the yarn tension acting with increasing winding diameter in order to avoid bulging on the winding. In this, therefore, a device is required for adjusting the thread tension in the overall course of the winding of a thread winding." It further provides a means for doing so.

However, these documents do not teach how to change the winding tension as a function of the bobbin diameter in discreet pressure change by means of selecting a specific pressure line.

There is therefore a need to develop a method of changing yarn winding tension such that when same bobbin is unwound, the weft tension is lower compared to conventionally wound bobbin at same bobbin size, to generate uniform quality woven fabric.

OBJECTS OF THE INVENTION

Accordingly, it is an object of the present invention to provide an automatic method of stepwise or gradually or discretely varying the dancing arm stiffness or resistance to its motion in relationship to build bobbin size.

Another object of the present invention is to reduce the width variation of fabric produced by using yarn from these bobbins.

SUMMARY OF INVENTION

The invention discloses an apparatus for regulating winding tension as function of bobbin (2) diameter in a slit film tape or yarn (1) winder system carrying at least one automated winder. It comprises a dancing arm (3) equipped with a tension setting means or device (3B) which regulates the yarn tension. The instantaneous position (3F) of said dancing arm (3) and resistance 'R' to movement of said dancing arm (3) during the winding process are variable. The inventive feature of the invention being provision of a tension setting means (3B) of changing resistance 'R' of the dancing arm (3) as a function of the bobbin (2) diameter 'D' during the winding process. The invention also provides a method for regulating winding tension as function of bobbin (2) diameter in a slit film tape or yarn (1) winder system. The invention helps overcome a number of problems related to uniformness and consistency of package the fabric making industry is currently facing. It solves technical problem of winding bobbin throughout using same tension adjusted for dancing arm, resulting higher tension during unwinding at low bobbin sizes. It also helps reduce the necking or shrinkage of the fabric produced due to varying resultant winding tension.

LIST OF PARTS

| | |
|---|---|
| Slit film tape (1) | Dancing arm at Instantaneous Position (3F) |
| Spindle with Bobbin (2) | Tensioning Bow (4) |
| Dancing Arm (3) | CAM Box (5) |
| Dancing Arm Rollers (3A) | Pressure Roller (6) |
| Tension setting device (3B) | Slit film tape Guide (7) |
| Dancing Arm Movement Delimiter (3C) | MMI (8) |
| Dancing Arm in optimal operating Position (3D) | Parent Controller (9) |
| Dancing Arm in End Position (3E) | Winder head controller (10) |
| | Pressure lines (11A and 11B)) |
| | Communication bus (12) |

BRIEF DESCRIPTION OF FIGURES

The objects and advantages of the invention thereof may be understood by making reference to the following description, taken with the accompanying drawings.

DETAILED DESCRIPTION OF THE INVENTION

Figure 1:
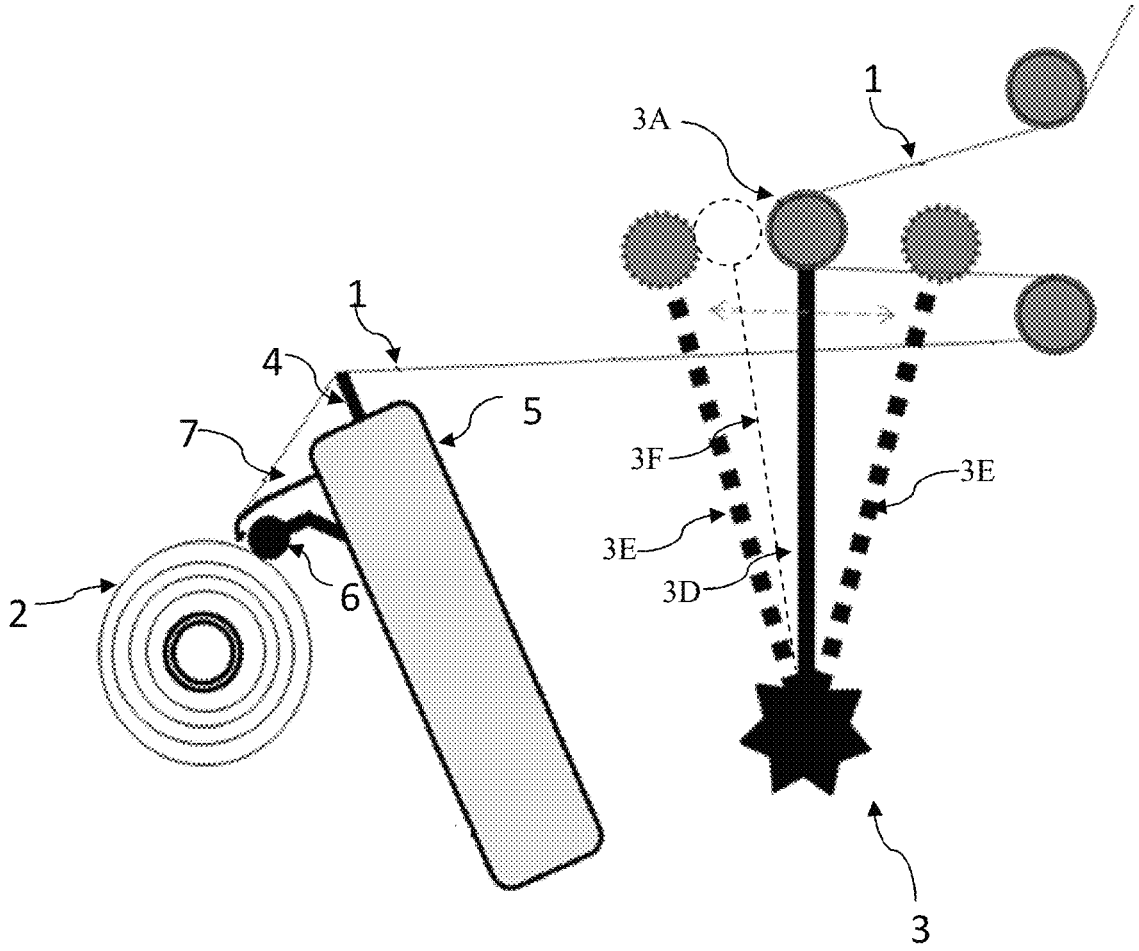
FIG. 1 shows a schematic of winder with oscillating Dancing Arm for slit film tape winding with a tension control knob
Figure 1A:
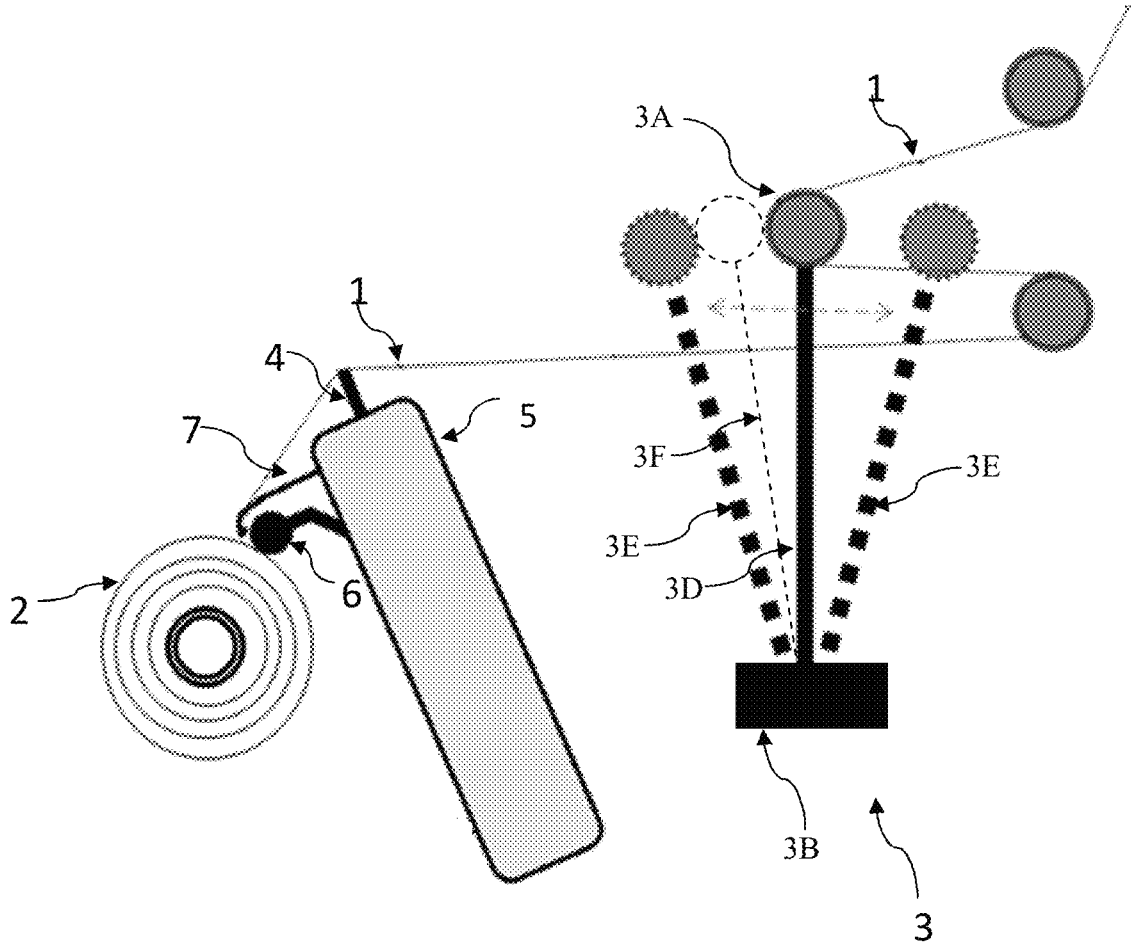
FIG. 1A shows the schematic of apparatus of the invention with a tension setting means/device deployed in a winder with oscillating Dancing Arm for slit film tape winding

FIG. 1A shows the apparatus of the invention. The invention discloses an apparatus for regulating winding tension as function of package diameters of bobbins that are used in a tapeline that deploys a number of bobbins (2) on which yarn (1) or slit-film tapes are wound to form packages. The apparatus uses a tension setting means (3B) for changing the variable resistance 'R' of a dancing arm (3) as a function of the bobbin/package diameter Tr. The apparatus is used for all types of yarns (1). The relationship between R and D is generally represented by a function 'f' as:

$$R=f(D) \qquad \text{Eq. 1}$$

Figure 2:
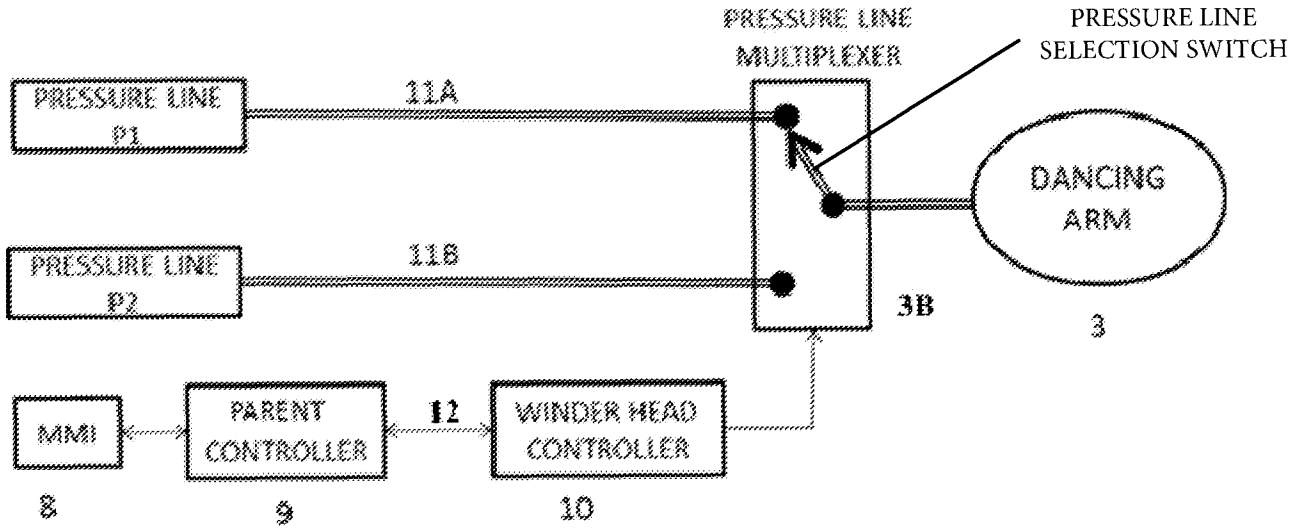
FIG. 2 shows a schematic of a two-step winding tension control logic of the invention

In a preferred embodiment the tension setting means (3B) of the apparatus—which controls the dancing arm (3) resistance 'R' in a gradual manner (i.e. changing pressure continuously) or in discrete steps—is a pressure line multiplexer (which selects a pressure line at any instance). In a pressure line multiplexer or pressure line multiplexing system, at least one (preferably two or more) of pressure lines (11A and 11B, for example) is connected for sourcing pressure. The pressure line multiplexer (3B) is also provided with a pressure line selection switch (FIG. 2). In one aspect of the invention where two pressure lines (11A and 11B) are provided, only one of the pressure lines (11A and 11B) is selected using the pressure line selection switch at a time and the pressure is transmitted to the dancing arm (3) for generating resistance R. This is illustrated with a schematic example shown in FIG. 2 for two discrete levels. FIG. 2 shows two pressure lines (11A and 11B) out of which any one line is active at any time. This can be suitably improved by using multilevel (or multi-stage or multi-stepped) multiplexing or a system to achieve continuously/gradually changing resistance 'R'.

The apparatus of the invention controls the dancing arm resistance 'R' in a gradual manner or in discrete steps by changing pressure continuously, or by selecting a pressure line at an instance. In a pressure line multiplexing system, a number of pressure lines can be sourced, but only one of them is selected for activation at a time and the pressure is forwarded to Dancing arm (3) for producing resistance 'R' to its oscillating movement.

The present invention also discloses a method for regulating winding tension as function of bobbin (2) diameter which dynamically changes set resistance of the dancing arm (3) during the yarn winding process by using pneumatic, or magnetic, or electromagnetic braking technology. The method disclosed by the invention involves determining at what point of bobbin (2) formation (bobbin diameter), the pressure exerted on the dancing arm by the pressure lines (11A and 11B) (and effectively the dancing arm resistance) needs to change. This is done on the basis of the pre-set relationship between R and D, which relationship is determined by individual users based on their own requirements and experience. The ideal operating pressure (the pressure exerted by the pressure line multiplexer on the dancing arm for optimal winding/package results) depends on bobbin diameter and would be known to a person skilled in the art. This pressure is optimized by the user for better quality of winding with optimum required tension. As the package grows in diameter, the pressure requirement changes. The optimal pressure is the pressure which sets resistance R to movement of the dancing arm to a level at which the package is wound with the correct tension in the yarn.

The relationship between package diameter and the pressure exerted by the tension setting means/device (3B) (or consequently the resistance 'R') is thus predetermined by the user. The preferred embodiment provides a two-stage pressure setting system. The inventors have found that, typically, the set tape (1) tension preferably lies between 0.08 cN to 0.1 cN per Denier. For example, if tape (1) denier which is getting wound on bobbin is 800, then system set tape tension must be in between 64 cN to 80 cN range. Based on these desired tape (1) tensions, knob settings are selected manually in current winding systems.

Typically, in conventional winders, the resistance R of the dancing arm (3) to its oscillating movement during the winding process is controlled by settings of a knob which can be set at various positions by adjusting torsion of the spring that is provided in the knob, which effectively increases stiffness of the dancing arm (3) system according to yarn (1) properties.

In FIG. 1, yarn '1' delivered from direction 'a' after cutting and conditioning from a tape line machine passes through a dancing arm roller (3A). A winder starts winding as the running yarn (1) passing through dancing arm (3) roller (3A) causes the dancing arm (3) to assume its instantaneous position (3F) due to the yarn tension required for winding.

Figure 4:
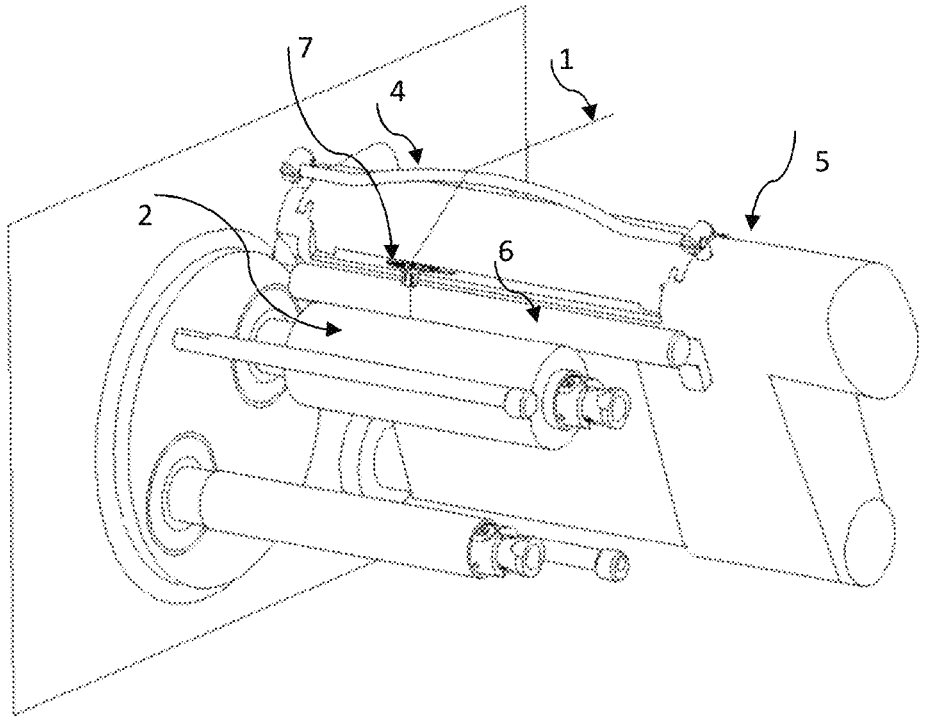
FIG. 4 shows the tape running over the tensioning bow, the pressure roller and the tape guide in action.

Also as shown in FIGS. 1 and 4, a CAM box assembly (5) constitutes a pressure roller (6), a tape guide (7), a tensioning bow (4) along with other assembly parts. The yarn (1) travels over the tensioning bow (4) before passing through the split film tape guide (7).

The pressure roller (6) presses the spindle (2) to maintain winding tension. The spindle rotational speed is electronically controlled in a closed loop as per feedback provided (see FIG. 2) on the dancing arm (3) deflection (i.e. information on the instantaneous position (3F) of the dancing arm (3) is monitored using a position sensor, relative to its optimal operating position (3D) during the winding operation) so as to provide optimal tension in the yarn. The optimal operating position (3D), as the name indicates, is the target position of the dancing arm (3) during the winding operation to achieve optimal package characteristics. However, during the winding operation, depending on the winding process parameters, the dancing arm (3) typically deviates from its optimal operating position (3D). The dancing arm (3) is arranged/designed such that as it is deflected angularly from its optimal operating position (3D) position, the spindle (2) starts rotating and thus yarn winding starts on spindle. The extreme positions (3E) which the dancing arm (3) is allowed to assume during a winding operation are facilitated by provision of a dancing arm (3) movement delimiter.

Typically, in the conventional devices, the setting of the tension setting knob is not changed during entire winding process. As a part of the closed loop, a position sensor which is mounted on dancing arm (3) regularly transmits details of the instantaneous position (3F) of dancing arm (3) to a winder head controller (10). Based on these details the machine operator makes a decision regarding manually tightening or loosening of the yarn (1). For instance, if the instantaneous position (3F) of the dancing arm (3) is such that the dancing arm (3) deflects from its optimal operating position (3D) towards the winding bobbin (2) then yarn (1) is travelling in a looser-than-desired state. On the other hand, if the dancing arm deflects away from its optimal operating position (3D) in a direction away from the winding bobbin 2), then yarn is traveling in a tighter-than-desired state. According to the instantaneous position (3F) of the dancing arm (3) deflection, positional details of the dancing arm (3) are communicated to the winder head controller (10) and thus the speed of spindle is regulated to control yarn tensioning.

As stated earlier, a major disadvantage of conventional yarn winding methods is that these are carried out at a constant knob setting, which in turn results in necking or shrinkage of the fabric produced due to varying resultant winding tension, and sometimes in undesired frequent weft breakages.

The pressure multiplexing system used in the present invention preferably uses pneumatic technology; however, it can also be implemented by using other technologies such as magnetic or hydraulic braking or any other technology existing or developed in future that can be used for applying braking. The device of the invention facilitates a procedure for changing the dancing arm oscillating resistance R proportionally to the bobbin diameter. The winder of the invention may be the conventional yarn winders or winders modified to use suitable pneumatic or hydraulic or magnetic systems to achieve winding functionality.

In FIG. 2, the functional diagram with preferred embodiments is described. A Man Machine Interface (MMI) (8) is provided for entering the desired machine/process related parameters of the winder machine (such as the yarn denier, weight, speed, the tube outer diameter), which are known to a person skilled in the art. The MMI (8), a parent controller (9) and winder head controller (10) communicate with each other either over serial or parallel bus backbone. The parent controller (9) is a channel for data-entering-point into an assembly of such winder units, whereas a winder head controller (1) (or simply a head controller) is a controller for each winder unit. There may be more than one winder unit in a winder family.

Similar to conventional systems, the parent controller (9) is provided to transfer data to all winder head controllers (10) for their operational requirements and functionality. Parent controller (9) thus transfers process data such as the line speed, winding recipe, etc. from each winder to respective winder head controllers (10). There may be more than one winder head controller (10); all winder head controllers (10) are connected to a single 'parent' controller (9) (also termed as the 'gateway' controller).

Figure 3:
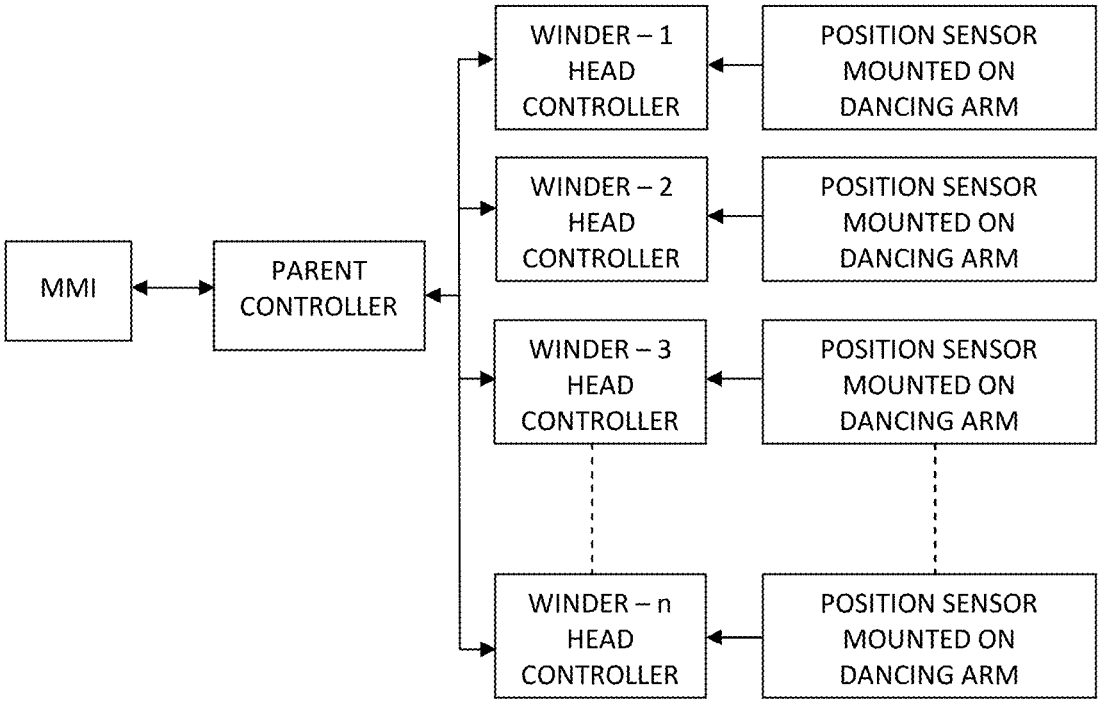
FIG. 3 shows a schematic of MMI, parent controller and winder head controllers

One of the embodiments of the present invention discloses a method where multiple control lines (or pressure lines, for example 11A and 11B) are supplied to line multiplexer and selected line (11A or 11B) is connected to the dancing arm (3) for control of resistance R according to yarn (1) properties. The variation in resistance can also be implemented by other means of braking which can be continuous or discrete in nature of application. The source of control of resistance 'R' can be pressure (applied to the pivot point of the dancing arm (3), about which the dancing arm (3) swings) or any other technique for controlling the winding tension. As an illustration, FIG. 3 shows two pressure lines (11A and 11B). According to the invention, one of the multiplexed pressure lines (11A or 11B) is connected to the dancing arm (3) at any time. The pressure line (11A or 11B) thus replaces the conventional torsional spring for adjusting oscillating resistance of the dancing arm (3). The pressure line multiplexer (12) is an electromechanical control device (for example, pneumatic valves which are electronically controlled for turning on or switching off) for selecting one line at a time to connect with dancing arm (3).

The pressure settings of the pressure lines (11A and 11B) can be changed manually or automatically according to the required pressure adjustment suitable for proper winding. The pressure settings depend on yarn properties required for optimal winding. Preferably, the pressure settings, the package cutoff size, and the final package size, are input using the MMI (8) prior to starting the winding operation. However, the settings may be adjusted during the winding process, without halting the winding operations.

The winder head controller (10) carries information about cutoff bobbin size of the package above which line-switching is required for optimal bobbin winding. As the cutoff bobbin size of the package is reached, winder head controller (10) generates a control signal to switch pressure lines. Bobbin size cutoff value is entered by the machine user on MMI (8) which communicates the bobbin size cut off value to winder head controllers (10) which are available on communication bus (12) (see FIG. 3). The ultimate size a package is allowed to reach is typically set before the winding operation is started, however, it may be adjusted during the winding operation.

It is possible to have different settings for different bobbins (2) that are being wound simultaneously, depending on the properties of the yarn which are getting wound. If same type of yarn (1) is used in a machine on all bobbins, then it is not required to have different pressure settings from bobbin to bobbin. However, in the case where different bobbins (2) are wound with yarns of different properties (such as denier) on the same tapeline machine then different settings may be required.

Pressure setting required for good winding (without side fall and better finish) depends upon yarn properties like denier and yarn winding tension. For a single low denier yarn (1), as a comparative measure, lower tension is required at lower diameter of bobbin (because at lower diameter yarn tension is higher due to higher angular velocity of bobbin) and higher tension at higher diameter of bobbin due lower angular velocity of bobbin. Thus, by keeping lower tension at lower diameter the higher tension of yarn (which results due to higher angular velocity) gets compensated. The actual values of the required tension are known to a person skilled in the art. On the contrary, if higher denier yarn is used (i.e. in case of heavy duty take-up winders) then the higher tension is required at smaller diameter and lower tension is required at higher bobbin diameters.

As discussed here, there are a number of issues addressed by the invention. First, invention solves technical problem of winding bobbin throughout using same tension adjusted for dancing arm, resulting higher tension during unwinding at low bobbin sizes.

Second, the problem stated in above context of fabric size variation also gets resolved because of less variation in unwinding slit film tape tension at smaller bobbin sizes. For example, the conventional winder results in fabric width variation of 10 to 12%, while the inventive winder bobbins resulted in fabric width variation of 4 to 6%.

It is evident from the foregoing discussion that the invention has a number of embodiments.

1. An apparatus for regulating winding tension as function of bobbin (2) diameter in a slit film tape or yarn (1) winder system carrying at least one winder, said apparatus comprising a dancing arm (3), the instantaneous position (3F) of said dancing arm (3) and resistance R to movement of said dancing arm (3) being variable during the yarn winding operation, wherein said apparatus comprises a tension setting device/means (3B) for changing said resistance 'R' of the dancing arm (3) as a function of the bobbin (2) diameter 'D' during the winding process; and wherein said tension setting device/means (3B) is a pressure multiplexer capable of changing said resistance R in discrete steps, characterized in that in the case of the discrete-stepped pressure change, said pressure multiplexer is provided with at least two separate pressure lines (11A and 11B) and a pressure line selection switch, wherein only one pressure line (11A or 11B) is activated at any time using said switch and the pressure is transmitted to said dancing arm (3) for generating resistance R.
2. An apparatus as disclosed in embodiment 1, characterized in that said pressure multiplexer is controlled with an electromechanical control device for selecting one pressure line (11A or 11B) at a time to connect with dancing arm (3), said electromechanical device preferably being a pneumatic valve which is electronically controlled for being turned on or switched off.
3. An apparatus as disclosed in embodiments 1 or 2, characterized in that said apparatus still further comprises a man machine interface (MMI) (8), a parent controller (9), and a winder head controller (10), wherein said pressure multiplexer (12) is capable of selecting a pressure line (11A or 11B) based on the feedback from said winder head controller (10).
4. An apparatus as disclosed in any one of embodiments 1 to 3, characterized in that said MMI (8) is capable of entering desired winder machine parameters such as the yarn denier, weight, speed, the tube outer diameter; said winder head controller (10) is capable of carrying information about cutoff bobbin size above which pressure line (11A or 11B) switching is required, there being provided one winder head controller (10) for each winder in the group of winders; said parent controller (9) is capable of transferring process data such as the line speed, winding recipe, etc. from each winder to respective winder head controllers (10).
5. An apparatus as disclosed in any one of embodiments 1 to 4, characterized in that said dancing arm has at any time an instantaneous position (3F) which is electronically monitored.
6. An apparatus as disclosed in any one of embodiments 1 to 5, characterized in that said tension setting device/means is electromechanically controlled.
7. An apparatus as disclosed in embodiment 3, characterized in that at least one of said winder head controllers, said parent controller, and said MMI are connected by a communication bus.
8. An apparatus as disclosed in embodiment 4 characterized in that said cutoff bobbin size value can be set during any stage of bobbin winding ranging from prior to winding start to attainment of predetermined full package size.
9. A method for regulating winding tension in a slit film tape or yarn (1) as function of bobbin (2) diameter, said method comprises the steps of:
   providing an apparatus as disclosed in any one of embodiments 1 to 4,
   determining the bobbin (2) diameter at which the resistance of said dancing arm needs to change
   dynamically changing the resistance of the dancing arm (3) during the yarn winding process by using pneumatic braking technology,
   characterized in that in said step of dynamically changing the resistance, the actual change in resistance is effected through a pressure multiplexer in discrete steps.

While the above description contains much specificity, these should not be construed as limitation in the scope of the invention, but rather as an exemplification of the preferred embodiments thereof. It must be realized that modifications and variations are possible based on the disclosure given above without departing from the spirit and scope of the invention. Accordingly, the scope of the invention should be determined not by the embodiments illustrated, but by the appended claims and their legal equivalents.

The invention claimed is:

1. An apparatus for regulating winding tension as function of bobbin (2) diameter in a slit film tape or yarn (1) winder system carrying a group of winders comprising at least one winder, said apparatus comprising a dancing arm (3), the instantaneous position (3F) of said dancing arm (3) and resistance R to movement of said dancing arm (3) being variable during the yarn winding operation, wherein said apparatus comprises a tension setting device/means (3B) for changing said resistance 'R' of the dancing arm (3) as a function of the bobbin (2) diameter 'D' during the winding process, and wherein said tension setting device/means (3B) is a pressure multiplexer capable of changing said resistance R in discrete steps, characterized in that in the case of the discrete-stepped pressure change, said pressure multiplexer is provided with at least two separate pressure lines (11A and 11B) and a pressure line selection switch, wherein only one pressure line (11A or 11B) is activated at any time using said switch and the pressure is transmitted to said dancing arm (3) for generating resistance R.

2. An apparatus as claimed in claim 1, characterized in that said pressure multiplexer is controlled with an electromechanical control device for selecting one pressure line (11A or 11B) at a time to connect with dancing arm (3), said electromechanical device preferably being a pneumatic valve which is electronically controlled for being turned on or switched off.

3. An apparatus as claimed in claims 1 or 2, characterized in that said apparatus still further comprises a man machine interface (MMI) (8), a parent controller (9), and a winder head controller (10), wherein said pressure multiplexer (12) is capable of selecting a pressure line (11A or 11B) based on the feedback from said winder head controller (10).

4. An apparatus as claimed in any of claim 3, characterized in that said MMI (8) is capable of entering desired winder machine parameters such as the yarn denier, weight, speed, the tube outer diameter; said winder head controller (10) is capable of carrying information about cutoff bobbin size above which pressure line (11A or 11B) switching is required, there being provided one winder head controller (10) for each winder in the group of winders; said parent controller (9) is capable of transferring process data of the line speed or winding recipe from each winder to respective winder head controllers (10).

5. An apparatus as claimed in claims 1 or 2, characterized in that said dancing arm has at any time an instantaneous position (3F) which is electronically monitored.

6. An apparatus as claimed in claims 1 or 2, characterized in that said tension setting device/means is electromechanically controlled.

7. An apparatus as claimed in claim 4, characterized in that said cutoff bobbin size value can be set during any stage of bobbin winding ranging from prior to winding start to attainment of predetermined full package size.

8. An apparatus as claimed in claim 3, characterized in that at least one of said winder head controllers, said parent controller, and said MMI are connected by a communication bus.

9. A method for regulating winding tension in a slit film tape or yarn (1) as function of bobbin (2) diameter characterized in that said method comprises the steps of:

providing an apparatus as claimed in claims 1 or 2, determining the bobbin (2) diameter at which the resistance of said dancing arm needs to change dynamically changing the resistance of the dancing arm (3) during the yarn winding process by using pneumatic braking technology, characterized in that in said step of dynamically changing the resistance, the actual change in resistance is effected through a pressure multiplexer in discrete steps.

* * * * *